US011626214B2

(12) United States Patent
Haspel et al.

(10) Patent No.: US 11,626,214 B2
(45) Date of Patent: Apr. 11, 2023

(54) SECURING SLEEVE WITH POSITIVE LOCKING ELEMENTS

(71) Applicant: TE Connectivity Germany GmbH, Bensheim (DE)

(72) Inventors: Michael Haspel, Bensheim (DE); Markus Eckel, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 107 days.

(21) Appl. No.: 17/198,434

(22) Filed: Mar. 11, 2021

(65) Prior Publication Data

US 2021/0287827 A1 Sep. 16, 2021

(30) Foreign Application Priority Data

Mar. 11, 2020 (DE) ..... 102020203158.4

(51) Int. Cl.
*H01R 4/26* (2006.01)
*H01B 7/17* (2006.01)
*H01R 9/05* (2006.01)

(52) U.S. Cl.
CPC ..... *H01B 7/17* (2013.01); *H01R 4/26* (2013.01); *H01R 9/0518* (2013.01)

(58) Field of Classification Search
CPC ..... H01R 4/26; H01R 9/0518; H01R 9/0512; H01R 9/05; H01R 13/65912; H01R 13/65914; H01R 12/596
USPC ..... 439/607.41, 98, 100, 108
See application file for complete search history.

(56) References Cited

U.S. PATENT DOCUMENTS 1,910,022 A * 5/1933 Legg ..... H01R 4/60 439/433
2,423,627 A * 7/1947 Tinnerman ..... F16L 3/1233 24/23 R
3,237,905 A * 3/1966 Baker ..... H05K 7/12 248/316.1
3,247,315 A * 4/1966 Wendells ..... H01R 4/10 403/313
3,594,692 A * 7/1971 Oakes ..... H01R 31/06 439/687
4,168,423 A * 9/1979 Gilreath ..... F24C 7/06 24/336
4,360,178 A * 11/1982 Senter ..... F16L 3/10 248/65

(Continued)

FOREIGN PATENT DOCUMENTS

WO 2019063641 A1 4/2019
WO 2020002225 A1 1/2020

OTHER PUBLICATIONS

European Search Report, Application No. 21 16 1653.7-1201, dated Aug. 17, 2021, 13 pages.

*Primary Examiner* — Harshad C Patel
(74) *Attorney, Agent, or Firm* — Barley Snyder

(57) ABSTRACT

A securing sleeve for securing a shield of an electric conductor to a shielding contact includes a securing section having a bottom disposed between a pair of wings. The bottom supporting the electric conductor. The wings are spaced apart at a free end of each of the wings distal from the bottom by a slot extending in an axial direction in an open state of the securing sleeve. The wings have a plurality of complementary positive locking element at the free ends that secure the securing sleeve in a circumferential direction in a closed state.

20 Claims, 4 Drawing Sheets

(56) References Cited

U.S. PATENT DOCUMENTS 4,958,792 A * 9/1990 Rinderer ..... F16L 3/13
24/457
5,533,696 A * 7/1996 Laughlin ..... F16L 3/12
248/74.1
5,616,036 A * 4/1997 Polidori ..... H01R 4/60
439/100
6,106,310 A * 8/2000 Davis ..... H01R 4/48
439/95
6,257,530 B1 * 7/2001 Tsai ..... F16L 3/127
248/74.2
6,354,543 B1 * 3/2002 Paske ..... H01P 1/00
248/68.1
7,021,967 B2 * 4/2006 Mullin ..... H01R 13/65917
439/607.41
8,662,455 B2 * 3/2014 Hernandez ..... F16B 2/245
248/222.12
9,431,741 B2 * 8/2016 Takahashi ..... H01R 13/18
9,903,510 B2 * 2/2018 Joshi ..... G02B 6/4471
10,637,226 B2 * 4/2020 Bell ..... F16L 3/222
10,823,312 B2 * 11/2020 Vaccaro ..... F16L 3/223
11,238,762 B2 * 2/2022 Vaccaro ..... G09F 15/0018
11,316,289 B2 * 4/2022 Schrettlinger ..... H01R 4/183
11,415,243 B2 * 8/2022 Vaccaro ..... F16B 21/065
2005/0109887 A1 * 5/2005 Catapano ..... H02G 3/30
248/68.1
2005/0109890 A1 * 5/2005 Korczak ..... H02G 3/30
248/68.1
2009/0230246 A1 * 9/2009 Depeige ..... B64C 1/1492
264/299
2014/0220834 A1 * 8/2014 Rizzo ..... H01L 31/042
439/834
2016/0281881 A1 * 9/2016 Vaccaro ..... E01F 9/65
2018/0245716 A1 8/2018 Nijdam et al.
2019/0334290 A1 * 10/2019 Droesbeke ..... H01R 12/7005

* cited by examiner

SECURING SLEEVE WITH POSITIVE LOCKING ELEMENTS

CROSS-REFERENCE TO RELATED APPLICATION

This application claims the benefit of the filing date under 35 U.S.C. § 119(a)-(d) of German Patent Application No. 102020203158.4, filed on Mar. 11, 2020.

FIELD OF THE INVENTION

The present invention relates to a securing sleeve and, more particularly, to a securing sleeve with positive locking elements.

BACKGROUND

Securing sleeves for contacting a shield of an electric conductor at a shielding contact are used, for example, in electric vehicles for high voltage applications. The securing sleeve may be pushed over the shield and clamp the shield between the securing sleeve and the shielding contact, for example by a crimping process, so that a constant contacting may take place even with high vibrating loads. In particular in high-voltage applications, it is important that high shielding currents can be conducted through the shielding device without major transition resistances. The securing sleeve is in most cases essentially cylindrical and is pushed onto the electric conductor. In particular with long conductor pieces, this can lead to high assembly efforts. Furthermore, many further process steps are required before the securing sleeve can be finally crimped.

SUMMARY

A securing sleeve for securing a shield of an electric conductor to a shielding contact includes a securing section having a bottom disposed between a pair of wings. The bottom supporting the electric conductor. The wings are spaced apart at a free end of each of the wings distal from the bottom by a slot extending in an axial direction in an open state of the securing sleeve. The wings have a plurality of complementary positive locking element at the free ends that secure the securing sleeve in a circumferential direction in a closed state.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
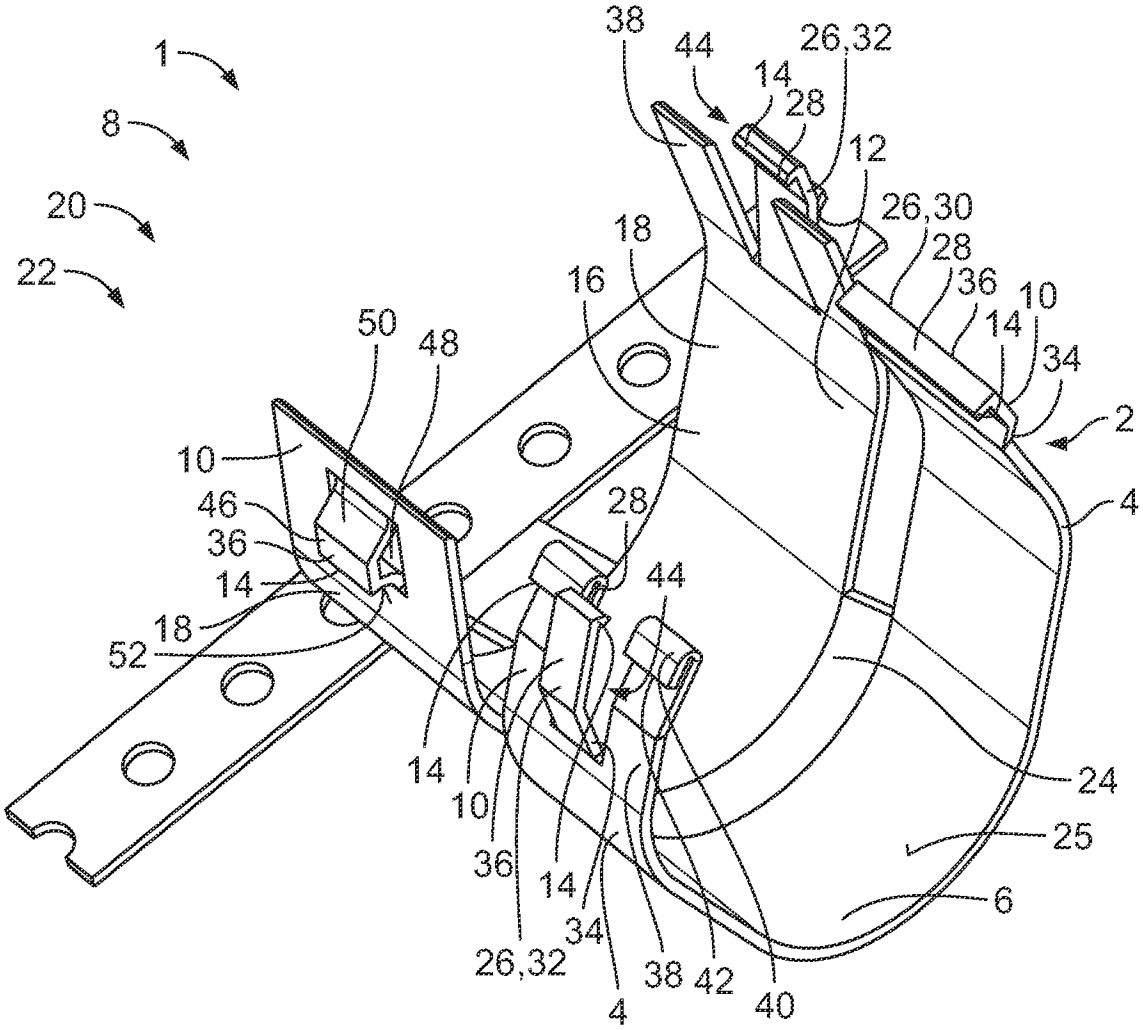
FIG. 1 is a perspective view of a securing sleeve according to an embodiment.

Below, the invention will be described more in detail by embodiments with reference to the enclosed drawings by way of example. In the figures, elements that correspond to each other concerning their construction and/or function are provided with the same reference numerals.

The combinations of features shown and described in the individual embodiments are only provided for illustration purposes. A feature of an embodiment may be omitted if its technical effect is not relevant for a certain application. Inversely, a further feature may be added to an embodiment if its technical effect is advantageous or necessary for a certain application.

A securing sleeve 1 according to an embodiment is shown in FIG. 1. The securing sleeve 1 comprises a securing section 2 with a bottom 6 located between two wings 4 for supporting an electric conductor. In an open state 8 before the fastening to the electric conductor, as it is shown in FIG. 1, the wings 4 are spaced apart at their free ends 10 facing away from the bottom 6 by a slot 12 extending in an axial direction. The wings 4 are provided with complementary positive locking elements 14 at their free ends 10 which secure the securing sleeve 1 in a closed state (see FIG. 4).

In the embodiment shown in FIG. 1, the securing sleeve 1 is to be fastened to various sections of the electric conductor, therefore the securing sleeve 1 may comprise a further securing section 16 spaced apart from the securing section 2 in the axial direction. The further securing section 16 can also comprise a further pair of wings 18, wherein the further wings 18 extend away from the bottom 6 in the circumferential direction. Similar to the first securing section 2, the further wings 18 may be spaced apart at their free ends 10 facing away from the bottom 6 in the open state 8 by the slot 12. The further wings 18 may also be provided with complementary positive locking elements 14 at their free ends 10.

The securing sleeve 1 may be integrally designed as a monolithic component 20, for example a punched and bent part 22. This may ensure a fast and inexpensive production, in particular in large scale manufacture. In order to contribute, in addition to the securing of a shielding contacting, to an electromagnetic compatibility of a contact arrangement, the securing sleeve 1 can be formed of an electrically conductive material, for example, aluminum, copper, or else tin-coated copper. Thereby, high shield currents may be conducted through the securing sleeve 1. In another embodiment, the securing sleeve 1 may also be formed of an electrically non-conductive material; the securing sleeve 1 may be formed of plastic, for example as a molded part.

The securing section 2 and the further securing section 16 may be connected to each other via the bottom 6. To this end, the bottom 6 may comprise a web section 24 shown in FIG. 1 extending in the axial direction between the two securing sections 2, 16.

Because the securing sections 2, 16 may be arranged at various sites of the electric conductor, the securing sections 2, 16 may enclose different predetermined diameters at least in the closed state. To this end, the wings 4 of the securing section 2 may comprise different curvatures and/or lengths compared to the further wings 18 of the further securing section 16, and vice versa. The securing sections 2, 16 can be offset with respect to each other in the radial direction. This may be realized, for example, in that the web section 24 radially tapers in the axial direction from the web section 2 to the further web section 16.

As an alternative, the contact arrangement may also comprise a plurality of securing sleeves 1 which are closed around various regions of the electric conductor. For example, a securing sleeve 1 can be closed around the insulation of the electric conductor, and a further securing sleeve 1 can be closed around the shield of the electric conductor.

According to a further embodiment, the securing sleeve 1 may be provided with a profiled surface at least in sections. For example, a radial inner surface 25 of the securing sleeve 1, shown in FIG. 1, may have, at least in sections, a serration, a honeycomb structure, a micro-structure, or the like. By the profiled surface, an increased surface roughness may be achieved which can avoid a slipping of the securing sleeve along the electric conductor.

Below, the complementary positive locking elements 14 of the securing section 2 will be described. The further wings 18 of the further securing section 16 can comprise, of course, the same positive locking elements 14 as the wings 4 of the securing section 2.

At least one wing 4 can be provided with at least one radially projecting latching tab 26, as shown in FIG. 1. The at least one latching tab 26 can in particular be cantilevered, whereby an elastic deflection of the at least one latching tab 26 is promoted. The at least one radially projecting latching tab 26 can be provided with a positive locking element 14. The positive locking element 14 can be a latching hook 28 radially projecting to the inside, for example. In an embodiment, the latching hook 28 can be arranged at a free end of the latching tab 26.

As can be seen in FIG. 1, the radially projecting latching tab 26 can form a section of the free end or else extend across the complete length in the axial direction X of the free end 10 and form the free end 10 itself. According to the exemplary embodiment in FIG. 1, a wing 4 may comprise a broad latching tab 30 forming the free end 10 of the wing 4, and the other wing 4 can comprise a narrow latching tab 32 forming a section in the axial direction X of the free end 10 of the wing 4. The broad latching tab 30 and the narrow latching tab 32 can be deflected in the radial direction to different degrees in the open state so that, during the closing operation, one latching tab 26 may slide over and beyond the other latching tab 26. In this exemplary embodiment, the narrow latching tab 32 is deflected in the radial direction further to the outside than the broad latching tab 30.

The at least one latching tab 32 may be, for example, a strip punched out of the free end of the wing 4 between the two fingers 38 which is on the one hand connected with its base to the remaining part of the wing 4, and which extends from the base at an inclined angle in the radial direction to the outside. The base may be a hinge, in particular an integral hinge, about which the latching tab 32 is rotatably connected with the remaining part of the wing 4.

As shown in FIG. 1, the latching tab 26 can have a slope section 34 by which the latching tab 26 is connected to the remaining wing 4 and which extends to the outside in the radial direction, and a support section 36 adjacent to the slope section 34 to rest at the other wing 4 in the closed state. The support section 36 can be straight so that the latching tab 26 can flatly rest against the other wing in the closed state. In an embodiment, the broad latching tab 30 and the narrow latching tab 32 may each be provided with complementary support sections 36, wherein in the closed state, the narrow latching tab 32 rests on the support section 36 of the broad latching tab 30 with its support section 36. The latching hook 28 of the narrow latching tab 32 projecting radially to the inside may abut against the slope section 34 of the broad latching tab 30, whereby the narrow latching tab 32 grips behind the broad latching tab 30 in the circumferential direction and thus prevents an opening of the wings 4 in the circumferential direction by a positive lock. Furthermore, by the support of the narrow latching tab 32 on the broad latching tab 30, it may be prevented that the broad latching tab 30 is radially moved to the outside in the closed state, for example, by vibrating loads.

A free end of the latching hook 28 faces radially to the inside, wherein no cavity between the latching tab 32 and the free end of the latching hook 28 is formed. This can prevent the positive lock from being formed in the cavity, which can result in excessive squeezing during the closing operation or a contact force that is too weak in the closed state.

The narrow latching tab 32 can be arranged in the axial direction between two fingers 38 extending in the circumferential direction in parallel to each other, as shown in FIG. 1. The fingers 38 may thus form the remaining part of the free end 10 of the wing 4. The fingers 38 may each be provided with a further positive locking element 14, for example in the form of a latching projection 40. The respective latching projection 40 can be directed against the latching hook 28 of the narrow latching tab 32, in particular, the respective latching projection 40 can be directed against the latching hook 28 of the broad latching tab 30, so that the latching hook 28 of the broad latching tab 30 and the respective latching projections 40 are engaged, in the closed state, with their outer surfaces facing away from the opposite wing in the circumferential direction, so that a positive lock is formed in the circumferential direction which prevents the opening of the securing sleeve 1. The complementary positive locking element 14 can, in the closed state 55, simultaneously form a positive locking with the latching hook 28 and the latching projections 40, thus providing additional retention if the connection at the latching hook 28 or at the latching projections 40 gets disengaged. In an embodiment, the fingers 38 and the latching tab 32 may be of equal length in the circumferential direction, so that they essentially limit the slot on a radial plane in the open state 8.

The outer surface of the respective latching projection 40 and of the latching hook 28 of the narrow latching tab 32 can be arranged offset with respect to each other in the circumferential direction, so that they are engaged with the broad latching tab 30 in a positive lock at different sites of the broad latching tab 30 in the circumferential direction. The respective latching projection 40 can be formed, for example, by bending back the free end of the respective finger 38. Here, the bent back end 42 of the finger 38 can abut against the remaining finger 38 so that here, no cavity is formed either.

The narrow latching tab 32 may be offset in the radial direction to the outside relative to the fingers 38, so that at least between the free ends of the latching tab 32 and the finger 38, a gap 44 shown in FIG. 1 is formed which is opened towards the slot 12 in the open state 8. The gap 44 can correspond, in particular in the radial direction between the latching projections and the latching hook 28 of the at least one narrow latching tab 32, at least to the material thickness in the radial direction of the broad latching tab 30 of the other wing 4, so that the broad latching tab 30 can be inserted into the gap 44 during the closing operation. Consequently, the wings 4 may overlap at least in sections in the closed state.

For the securing section 2 of the securing sleeve 1 to be able to lie around the shield as flatly as possible in the closed state, the broad latching tab 30 may be offset radially to the outside relative to the fingers 38. At least the support section 36 of the broad latching tab 30 can comprise an offset relative to the latching projections 40 of the fingers 38 which essentially corresponds to the thickness of the fingers 38 in the radial direction at the site with the latching projections 40, so that the latching projections 40 may abut against a radial inner surface of the broad latching tab 30 in the closed state. Consequently, an annular inner contour as uniform as possible can be produced in the closed state, whereby the shield may be contacted as uniformly as possible. The latching projections 40 of the respective fingers 38 can be arranged at one level in the circumferential direction.

Now, a further embodiment of a positive locking arrangement will be described with reference to the further securing section 16. One wing 18 can comprise, as described above, a narrow cantilevered latching tab 26 radially projecting to the outside which is arranged in the axial direction between two fingers 38, as shown in FIG. 1. In contrast to the fingers 38 in the securing section 2, the fingers 38 do not comprise any latching projections in the further securing section 16. Consequently, in this embodiment, a positive lock is only produced over the narrow latching tab 26.

Opposed to the narrow latching tab 26, the other wing 18 may have a complementary latching nose 46 as shown in FIG. 1. The latching nose 46 may project to the outside in the radial direction and have a higher stiffness compared to the narrow latching tab 26. Higher stiffness means that the latching nose 46 can be elastically deflected to a lesser degree than the latching tab 26 of the opposite wing; the latching nose 46 may be rigid.

To increase the stiffness of the latching nose 46, the latching nose 46 may be fixed to the remaining wing 18 at both ends located in the circumferential direction. The latching nose 46 can be, for example, a punched-out part of the wing 18, wherein it is arranged in a window 48 radially penetrating the wing 18 and is fixed to the frame of the window 48 with its ends. The latching nose 46 has approximately the same width in the axial direction as the latching nose 26 at the other wing 18.

As shown in FIG. 1, the latching nose 46 can be provided with a guide bevel 50 at a side facing the other wing 18 which is inclined away from the other wing 18 radially to the outside in the circumferential direction. The latching tab 26 of the other wing 18 can consequently slide along the guide bevel 50 during the closing operation and finally be pushed over the latching tab 26. The guide bevel 50 is followed by a straight support section 36 in the circumferential direction away from the other wing 18 on which support section the latching tab 26 may rest with its support section 36 in the closed state. The support section 36 can descend radially to the inside in steps at its end facing away from the opposite wing 18, so that a radially directed stop face 52 facing away from the opposite wing 18 is formed against which the latching hook 28 of the latching tab 26 can abut in the closed state and thus may prevent a relative movement of the further wings 18 in a direction apart from one another by a positive lock.

Figure 2:
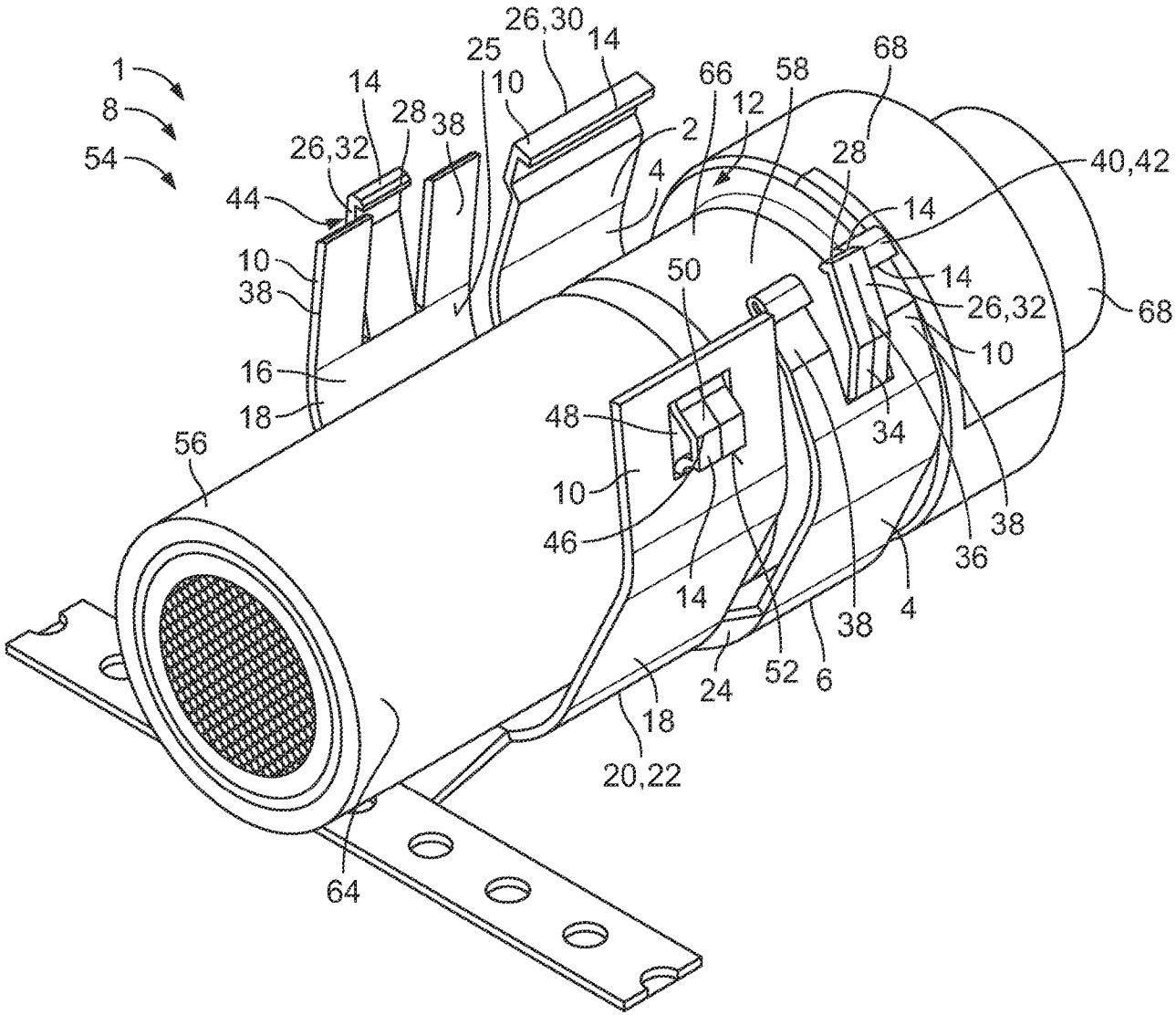
FIG. 2 is a perspective view of a contact arrangement according to an embodiment including the securing sleeve.
Figure 3:
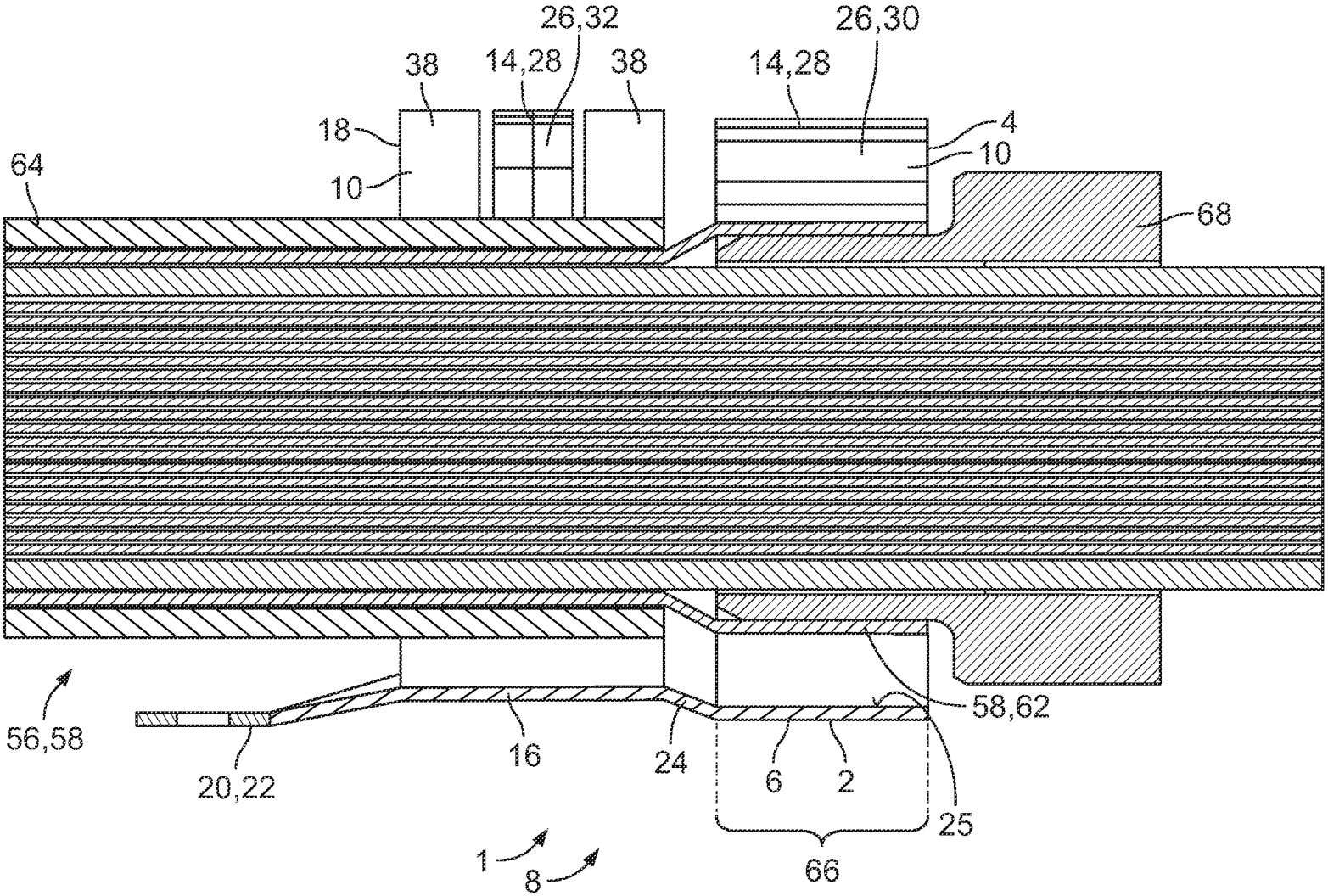
FIG. 3 is a sectional side view of the contact arrangement of FIG. 2.
Figure 4:
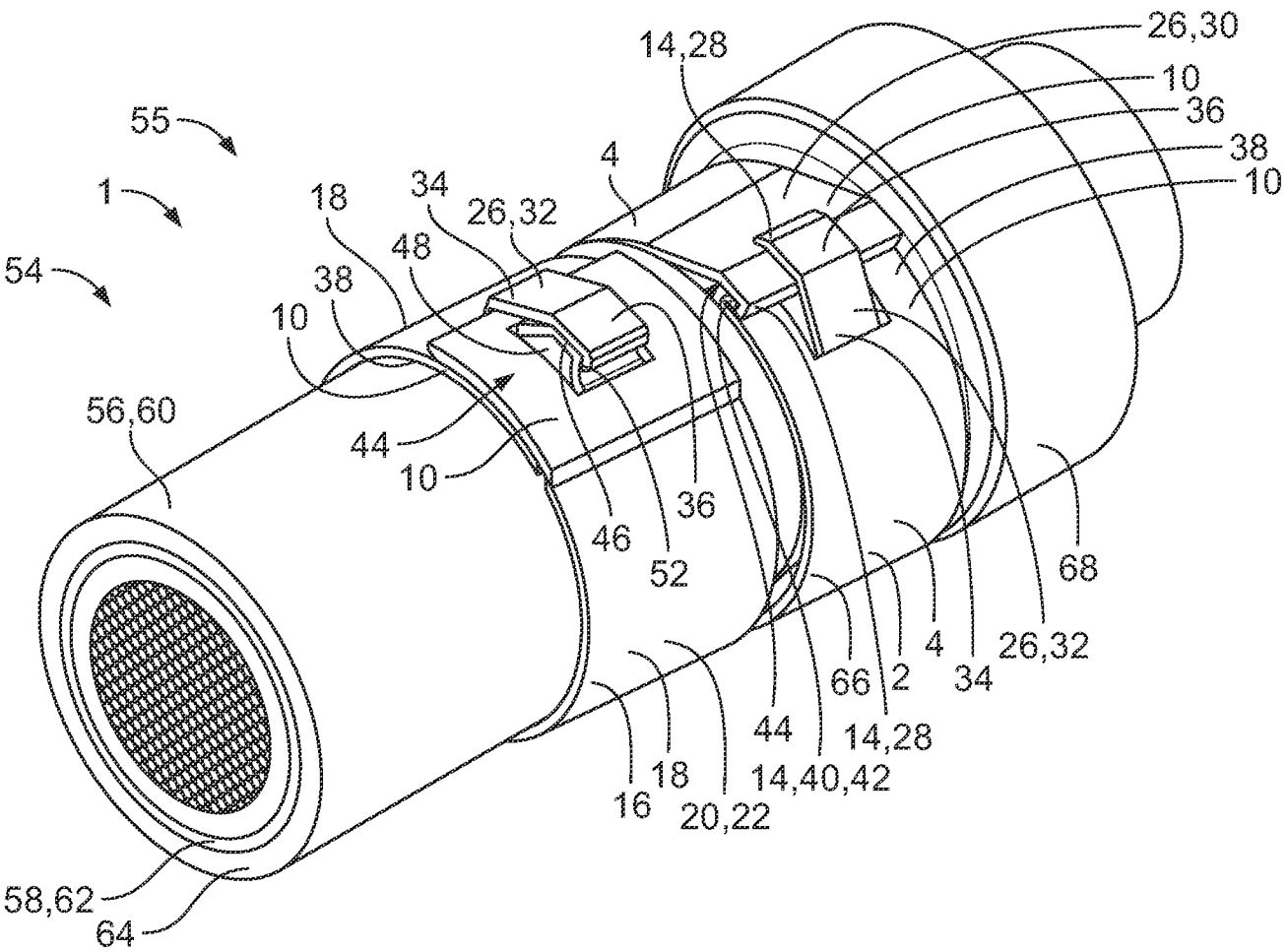
FIG. 4 is a perspective view of the contact arrangement of FIG. 2 in a closed state.

A contact arrangement 54 will now be described with reference to FIGS. 2-4. In FIG. 2 and FIG. 3, the contact arrangement 54 is shown with a securing sleeve 1 in an open state 8. In FIG. 4, the contact arrangement 54 is shown in a closed state 55 of the securing sleeve 1.

The exemplary embodiment of the contact arrangement 54 according to the invention, as shown in FIGS. 2 and 3, comprises an electric conductor 56 with a shield 58 and a securing sleeve 1 according to the embodiment represented in FIG. 1. The electric conductor 56 can in particular be an electric cable 60 with a shielding braid 62 and an insulation 64 enveloping the shielding braid 62, the shielding braid 62 being exposed from the insulation 64 in a contacting region 66. The shielding braid 62 can be flared in the contacting region 66, so that a shielding contact 68 for contacting the shielding braid 62 can be pushed under the shielding braid (see FIG. 3). The contact arrangement 54 may be designed, for example, to transmit up to approximately 50% of the rated current of the electric conductor 56.

According to a further advantageous embodiment, a support sleeve may be pushed under the shield 58, in particular the shielding braid 62. The support sleeve 1 can contribute to the increase in mechanical strength and form a support so that the securing sleeve can be pressed with the shielding braid 62 and the shielding contact 68 during the closing operation. In this case, the shielding contact 68 can also be arranged between the shielding braid 62 and the securing sleeve 1.

The electric conductor 56 can be unipolar or multipolar, for example. For example, the electric conductor 56 may comprise one single conductor wire surrounded by the shield 58. As an alternative, the electric conductor 56 can also comprise a plurality of conductor wires surrounded by a common shield 58. The shield 58 can comprise aluminum, copper, or tin-coated copper, for example. The shielding contact 68 can be an aluminum contact, for example. Of course, the shielding contact 68 can be formed of another, electrically conductive material, for example copper, or else tin-coated copper.

The securing sleeve 1 is arranged with its securing section 2 at the contacting region 66, so that the securing sleeve 1 presses the shielding braid 62 against the shielding contact 68 in the closed state 55 and thus secures the contacting between both components. The further securing section 16 is arranged in the region of the insulation 64, so that the securing sleeve 1 may be additionally fastened to the insulation 64 via the further securing section 16.

As shown in FIG. 4, the wings 4 and/or the further wings 18 overlap in the closed state 55. In an embodiment, the overlapping ends are pressed against each other, so that in addition to the securing of the securing sleeve 1 by positive locking elements 14, the wings 4 or the further wings 18, respectively, are held together by a plastic deformation. This can avoid that, for example, the latching tabs 26 are deflected radially to the outside.

The closing of the securing sleeve 1 may cause a plastic deformation of the shield 58, wherein the shield 58 is pressed against the shielding contact 68. The shielding contact 68 can also be plastically deformed in the process. As an alternative, the shielding contact 68 may not be plastically deformed during the closing operation.

In an embodiment, during the closing operation of the securing sleeve 1, first a plastic deformation can take place at the bottom 6, whereby the free ends 10 are pivoted towards each other. Subsequently, the wings 4 may be deflected elastically towards each other, so that the complementary positive locking elements 14 interlock and prevent a return of the wings 4 due to the elastic restoring force. Here, due to the elastic resilience of the wing 4*s*, a normal contact force may act from the securing sleeve 1 onto the shield 58 by which the shield 58 is pushed against the shielding contact 68.

By the pressing, an offset may be formed at one wing radially to the outside, as can be seen in the further securing section 16 in FIG. 4. The section of the wing 18 received in the gap 44 rests on the fingers 38 of the other wing 18, wherein during the pressing operation, the non-received part of the wing 18 is pressed against the electric conductor 56. Thus, an offset having the material thickness of the fingers is automatically generated between the wings 18. Consequently, the securing sleeve 1 can rest with its further securing section 16 as uniformly as possible on the surface area of the electric conductor 56 and contact the same.

In an embodiment, the securing sleeve 1 is not crimped in the closed state 55. The complementary positive locking elements 14 may not be crimped to each other in the closed state 55. Therefore, by the securing sleeve 1, the repairability of the contact arrangement 54 can be improved compared to a contact arrangement with a crimp sleeve. Since the securing sleeve 1 is not crimped in the closed state it can be easily reopened. Consequently, the securing sleeve 1 can be easily exchanged in a contact arrangement 55.

The complementary positive locking elements 14 may be interlocked under tensile stress in the closed state 55. The positive locking elements 14 can compensate an elastic restoring force between the two wings 4 in the closed state 55, wherein the securing sleeve 1 is at least in sections opened by the elastic restoring force by releasing the lock. Thereby, the exchange of the securing sleeve 1 in a contact arrangement 55 may be further facilitated.

The complementary positive locking element 14 does not have to be initially moved over and beyond the free end of the latching hook 28 in the circumferential direction to hook on in the cavity. The securing sleeve 1 does not need to be compressed more during the closing operation than in the closed state 55. It can furthermore be prevented that the contact force in the closed state 55, which acts from the securing sleeve 1 onto the shield 58 and/or the shielding contact 68, is too low.

The securing sleeve 1 may be elastically deformable, wherein the securing sleeve 1 is in a non-deformed state in a starting position in an open state 8 (see FIGS. 1 to 3), and is elastically deformed at least in sections in the closed state 55. The elastic deformation may be secured by the complementary positive locking elements 14.

The securing sleeve 1 may be deformed merely elastically in the closed state 55, whereby, after the release of the lock of the complementary positive locking elements 14, the securing sleeve 1 will return to its non-deformed state in the starting position by the elastic restoring force. In an embodiment, the securing sleeve 1 can have, in addition to an elastically deformed section, a plastically deformed section in its closed state. For example, at least the bottom 6 may be plastically deformed, and at least one section of the wings 4, in particular the free ends 10 of the wings 4, may be elastically deformed. Via the elastically deformed section, a normal contact force may be generated by the securing sleeve 1 and act onto the shield 58 and the shielding contact. Thus, by the securing sleeve 1, a sufficient normal contact force for contacting the shield 58 with the shielding contact 68 may be achieved.

Since the securing sleeve 1 should not be crimped, the securing sleeve 1 may have a lower strength, in particular material thickness, compared to a crimp sleeve. The securing sleeve 1 may be provided for an electric conductor of a predetermined diameter and may have a lower strength, in particular material thickness, compared to a crimp sleeve standardized for the electric conductor of a predetermined diameter. Thereby, material costs may be saved, and the weight of the securing sleeve 1 can be reduced.

The use of a securing sleeve 1 according to one of the preceding embodiments may lead to a facilitated installation since the securing sleeve 1 no longer needs to be pushed over the electric conductor 56 in the axial direction. The securing sleeve 1 may be inserted directly at the site where it is to be connected to the electric conductor 56; the electric conductor 56 may be inserted in the radial direction through the slot 12 between the two wings 4 after the necessary process steps have been accomplished. The slot 12 can have, for example, in the opened state a width in the circumferential direction between the free ends of the wings 4 that is larger than a predetermined diameter of the electric conductor 56, at least in the region of the shield 58. Thereby, the electric conductor 56 can be easily inserted into the securing sleeve 1 without getting caught at the free ends of the wings 4. Thereby, above all the susceptibility of failures in an automated assembly may be reduced.

Consequently, process steps which no longer permit the pushing on of the securing sleeve 1 onto the electric conductor 56 in the axial direction can be performed before the securing sleeve 1 is inserted. Furthermore, in contrast to a cylindrical crimp sleeve, it is possible to reopen the securing sleeve 1 in the closed state, whereby it may be easily replaced.

What is claimed is:

1. A securing sleeve for securing a shield of an electric conductor to a shielding contact, comprising:

a securing section having a bottom disposed between a pair of wings, the bottom supporting the electric conductor, the wings are spaced apart at a free end of each of the wings distal from the bottom by a slot extending in an axial direction in an open state of the securing sleeve, the wings have a plurality of complementary positive locking element at the free ends that secure the securing sleeve in a circumferential direction in a closed state, at least one of the complementary positive locking elements is a projecting latching tab including a latching hook projecting one of radially inward toward the slot or radially outward away from the slot in the closed state.

2. The securing sleeve of claim 1, wherein the securing sleeve is not crimped in the closed state.

3. The securing sleeve of claim 1, wherein the complementary positive locking elements are interlocked under a tensile stress in the closed state.

4. The securing sleeve of claim 1, wherein the radially projecting latching tab has a straight support section by which the radially projecting latching tab abuts against one of the wings in the closed state.

5. The securing sleeve of claim 1, wherein the radially projecting latching tab extends in the axial direction across a complete length of one of the wings.

6. The securing sleeve of claim 1, wherein the radially projecting latching tab is arranged between a pair of fingers, the radially projecting latching tab and the pair of fingers extending from a first one of the wings, the fingers extending in parallel to each other in the circumferential direction.

7. The securing sleeve of claim 6, wherein a second one of the wings is inserted through a gap between the fingers and the radially projecting latching tab in the closed state.

8. The securing sleeve of claim 7, wherein the fingers each have a latching projection that projects in a radial direction opposite to the latching hook, one of the latching projections or the latching hook engaging a radially outward facing side of the second wing, and the other one of the latching projections of the latching hook engaging a radially inward facing side of the second wing in the closed state.

9. The securing sleeve of claim 1, wherein at least one of the wings has a rigid latching nose projecting radially to an outside.

10. The securing sleeve of claim 9, wherein the rigid latching nose is one of the complementary positive locking elements.

11. The securing sleeve of claim 1, further comprising a further securing section with a pair of further wings spaced apart from the securing section in the axial direction.

12. The securing sleeve of claim 11, wherein the further wings extend away from the bottom and have the complementary positive locking elements.

13. A contact arrangement, comprising:

an electric conductor with a shield;

a shielding contact contacting the shield; and a securing sleeve securing the shield to the shielding contact, the securing sleeve including a first securing section having a bottom disposed between a pair of wings, the bottom supporting the electric conductor, the wings are spaced apart at a free end of each of the wings distal from the bottom by a slot extending in an axial direction in an open state of the securing sleeve, the wings have a plurality of complementary positive locking element at the free ends that secure the securing sleeve in a circumferential direction in a closed state, wherein the shielding contact is arranged on a radially inner side of the shield and the first securing section of the securing sleeve is arranged on a radially outer side of the shield such that the shield arranged between the securing sleeve and the shielding contact.

14. The contact arrangement of claim 13, wherein the securing sleeve further comprises a second securing section having a pair of further wings spaced apart from the first securing section in the axial direction, the first securing section arranged over the shield and the second securing section arranged over an outer insulation layer of the electric conductor.

15. A securing sleeve for securing a shield of an electric conductor to a shielding contact, comprising:

a first securing section having a bottom disposed between a first wing and a second wing, the bottom adapted to support the electric conductor, the first and second wings are spaced apart at a free end of each of the wings distal from the bottom by a slot extending in an axial direction in an open state of the securing sleeve, the first and second wings having have a plurality of complementary positive locking element at the free ends that secure the securing sleeve in a circumferential direction in a closed state, the first wing having:

a first latching hook formed on a free end thereof and engaging with a first side of a first latching tab of the second wing in a closed state of the sleeve; and at least one latching projection formed on the free end thereof and engaging with a second side of the first latching tab of the second wing, opposite the first side in a radial direction.

16. The securing sleeve of claim 15, wherein the second wing includes a second latching hook extending from the first latching tab and engaging with the latching projection of the first wing.

17. The securing sleeve of claim 16, wherein the first latching hook of the first wing is formed on a free end of a second latching tab extending in a circumferential direction of the securing sleeve in the closed state.

18. The securing sleeve of claim 17, wherein the second latching tab is arranged between a pair of fingers extending from the first wing, each finger including one of the at least one latching projection.

19. The securing sleeve of claim 18, wherein the second wing is inserted through a gap between the second latching tab and the at least one latching projection such that second wing is arranged between the second latching tab and the at least one latching projection in a radially outward direction.

20. The securing sleeve of claim 18, further comprising a second securing section including a third wing and a fourth wing, the second securing section arranged adjacent to the first wing and the second wing of the first securing section on a first side thereof in the axial direction.

* * * * *